United States Patent [19]

Nakatomi et al.

[11] Patent Number: 4,809,032

[45] Date of Patent: Feb. 28, 1989

[54] PRINTING APPARATUS

[75] Inventors: Yoshitsugu Nakatomi, Yokosuka; Goro Oda, Sagamihara, both of Japan

[73] Assignee: Kabushiki Kaisha Toshiba, Kawasaki, Japan

[21] Appl. No.: 127,373

[22] Filed: Dec. 2, 1987

[30] Foreign Application Priority Data

Dec. 10, 1986 [JP] Japan ..... 61-292481
Dec. 10, 1986 [JP] Japan ..... 61-292482

[51] Int. Cl.[4] ..... G03G 15/00

[52] U.S. Cl. ..... 355/3 TR; 355/3 SH; 355/3 R

[58] Field of Search ..... 355/3 TR, 3 R, 3 SH, 355/14 SH, 3 BE; 346/160

[56] References Cited

U.S. PATENT DOCUMENTS 3,661,452 5/1972 Hewes et al. ..... 355/3 BE
3,700,323 10/1972 Guyette et al. ..... 355/3 BE
3,719,481 3/1973 Makino et al. ..... 355/3 BE
4,247,193 1/1981 Kaneko et al. ..... 355/3 SH

*Primary Examiner*—R. L. Moses

*Attorney, Agent, or Firm*—Foley & Lardner, Schwartz, Jeffery, Schwaab, Mack, Blumenthal & Evans

[57] ABSTRACT

A laser beam printer includes a beam deflector for selectively exposing a surface of a drum-like photoreceptor to form an electrostatic latent image thereon, a developer for depositing toner powder to the latent image, a transfer charger for transferring the developed image onto paper, and a tray for sequentially stacking paper sheets carrying the transferred images thereon. Since the transfer charger is disposed above the photoreceptor to face it, the image is transferred on a lower surface of the paper. After the image is transferred to paper, the paper is delivered to the tray by delivery rollers. The transfer charger and the delivery tray are mounted on a pivotal door, thus enlarging a space between the photoreceptor and the transfer charger.

5 Claims, 4 Drawing Sheets

PRINTING APPARATUS

BACKGROUND OF THE INVENTION

The present invention relates to a printing apparatus and, more particularly, to a laser beam printer using the electrophotographic or xerographic processes.

A printing apparatus has been developed, and is known in the art, in which a laser beam is modulated in accordance with image information coming from an electronic computer or the like. The modulated beam is focused on a photoreceptor while scanning through optical elements such as a light deflecting device and a lens to selectively expose the photoreceptor. Then, latent images are formed on the surface of the photoreceptor. The latent image on the photoreceptor faces a developing device to deposit toner particles on the charged image area. Thereafter, the developed image is transferred to a paper sheet by electrostatic force at a transfer station. The printed sheet is passed through a fixing device.

As disclosed in, e.g., U.S. Pat. No. 4,460,909, paper sheets for printing are stored in a stacker, and are fed to the transfer station one by one. A paper sheet on which a developed image is transferred by the transfer station is delivered on a tray while the developed image faces up.

However, in the above-mentioned arrangement, when a continuous printing operation is performed in accordance with image information from the computer, the order of pages of the printed paper sheets is reversed. More specifically, the paper sheet of the first page is stacked at a lowermost position on the tray, and the paper sheet of the last page is stacked on the uppermost position on the tray. Furthermore, when the paper sheet jams in the transfer station, since the transfer station is located inside the printer, it is difficult to recover the jamming sheet.

SUMMARY OF THE INVENTION

Accordingly, it is a first object of the present invention to provide an improved printing apparatus capable of ordering pages of printed paper sheets.

It is a second object of the present invention to provide a printing apparatus which can easily recover from a paper jam.

To achieve the first object, the present invention provides a printing apparatus comprising means for forming an image on an image carrier, means for transferring the image formed on the image carrier by the image forming means to a sheet, so that an image is transferred onto a lower surface of the sheet, and means for stacking the sheet such that the lower surface to which the image is transferred by the transfer means faces down without being reversed.

To achieve the second object, the present invention further provides a printing apparatus comprising means for forming an image on an image carrier, means for transferring the image formed on said image carrier by the image forming means to a sheet, so that an image is transferred onto a lower surface of the sheet, means for conveying the sheet carrying the image on the lower surface thereof such that the lower surface faces down, the conveying means having first and second members facing each other and cooperating to clamp and convey the sheet, means for stacking the sheet conveyed by the conveying means, and means for supporting at least one of the transfer means and the first member to be movable between a first position at which the transfer means faces the image carrier to achieve the image transfer from the image carrier to the sheet and the first member faces the second member so as to cooperate each other, and a second position at which the transfer means and the first member do not face the image carrier and the second member, respectively.

BRIEF DESCRIPTION OF THE DRAWINGS

A more complete appreciation of the present invention and many of its attendant advantages will be readily obtained by reference to the following detailed description considered in connection with the accompanying drawings, in which.

DETAILED DESCRIPTION OF THE PREFERRED EMBODIMENT

Figure 1:
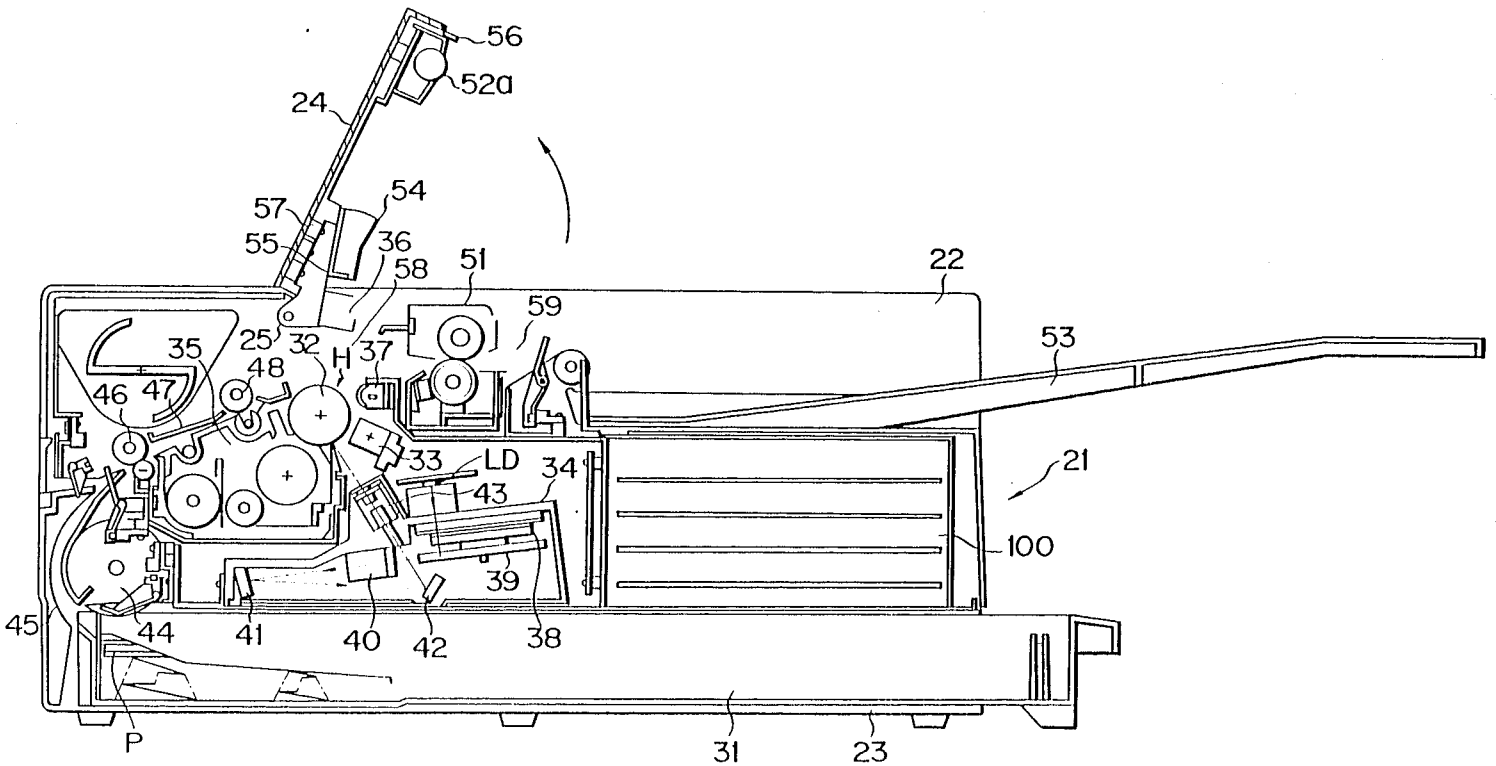
FIGS. 1 and 2 are schematic front views showing the interior of a laser beam printer according to the present invention.
Figure 2:
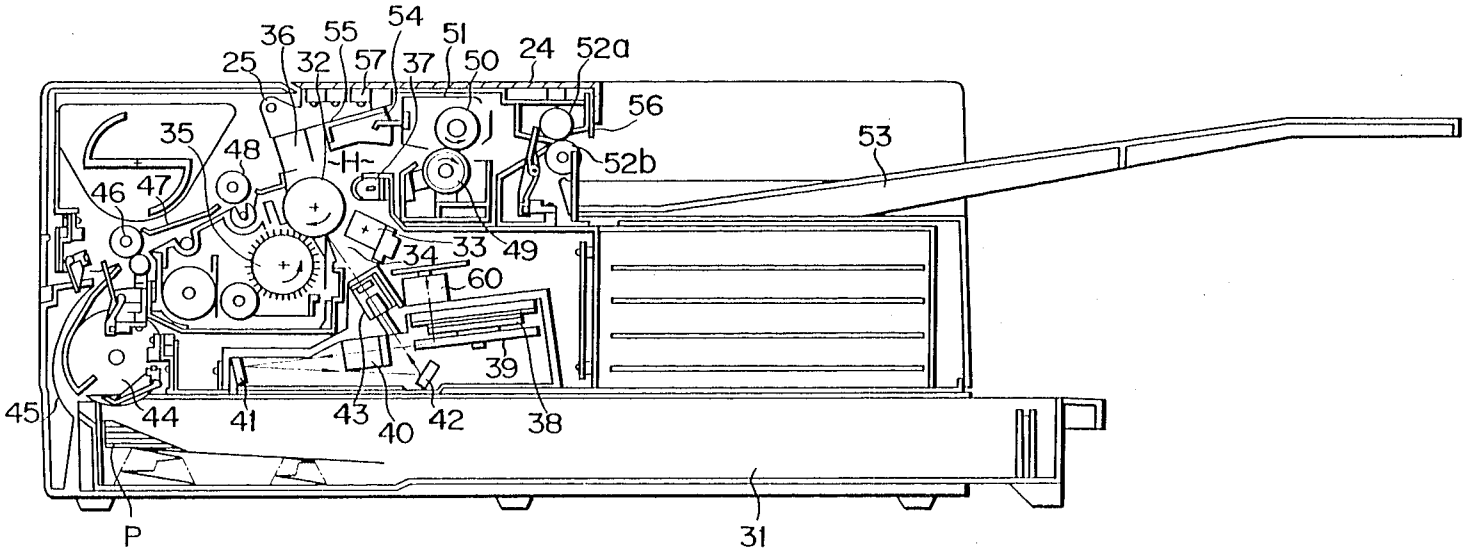
Figure 3:
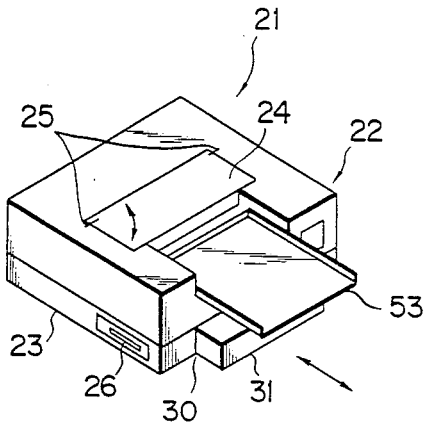
FIGS. 3 and 4 are perspective views of an outer appearance of the laser beam printer shown in FIG. 1 when viewed from different directions.
Figure 4:
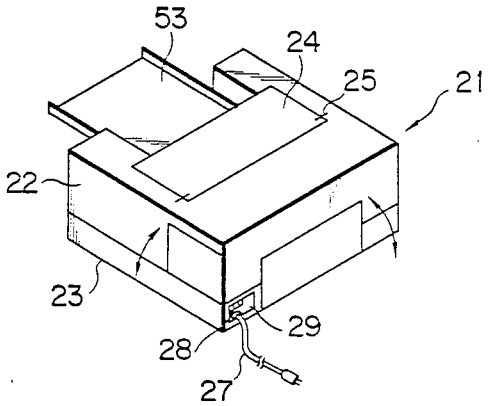

Referring to FIGS. 1 to 4, a laser beam printer is generally designated by 21. Laser beam printer 21 comprises upper casing 22 and lower casing 23. Door 24 is provided on the upper surface portion of upper casing 22. Door 24 is arranged to be openable/closable in a direction indicated an arrow about pivot shaft 25. Interface connector 26 for receiving image information from an external computer is provided on one side surface portion of lower casing 23. Power supply cord 27, power switch 28, and ground terminal 29 (see FIG. 4) are disposed on the rear surface portion of lower casing 23. Space 30 is provided in lower casing 23. Paper feed cassette 31 which is detachable in a direction indicated by an arrow is inserted in space 30.

Drum-like photoreceptor or photosensitive drum 32 serving as an image carrier is arranged in laser beam printer 21 to be rotatable in a direction indicated by an arrow. Corona discharger 33 for uniformly charging drum 32, exposure unit 34 for exposing the charged surface of drum 32, developing unit 35 for depositing toner powder on the surface of drum 32, transfer charger 36 for transferring the toner image to a paper and discharger 37 for removing a residual charge on the surface of drum 32 are sequentially disposed around drum 32 along its rotational direction.

Exposure unit 34 includes polygonal mirror 39 which is rotated by drive motor 38. Upon rotation of polygonal mirror 39, light emitted from laser diode LD is scanned in the axial direction of drum 32 based on information sent from an external personal computer or a wordprocessor. Light 60 reflected by polygonal mirror 39 is radiated onto drum 32 through lens 40 and first and second mirror 41 and 42, and through lens 43.

Paper sheets P as media to which images are transferred are stored in paper feed cassette 31. Paper sheets P are picked up one by one upon rotation of paper feed roller 44. Picked-up sheet P is fed to register rollers 46 through guide 45. Register rollers 46 register paper sheet P, and feed it to transfer position H, located above drum 32, through guide 47 and feed roller 48. At transfer position H, transfer charger 36 and paper guide 54 oppose drum 32 along the convey direction of paper sheet P. Fixing unit 51 comprising heat roller 49 and press roller 50, a pair of discharge rollers 52*a* and 52*b*, and discharging brush 56 are sequentially disposed along the convey direction of paper sheet P. Discharge tray 53 is arranged at the delivery side of discharge rollers 52*a* and 52*b*.

During image formation, the surface of drum 32 is uniformly charged by discharger 33. Information light 60 is scanned on the upper surface of charged drum 32 upon rotation of polygonal mirror 39. As a result, an electrostatic latent image is formed. The latent image is developed by deposition of toner powder in developer 35. At this time, paper sheets P are picked up one by one from cassette 31 upon rotation of roller 44, and are fed to register rollers 46 via guide 45. Each paper sheet p is registered by rollers 46, and is then fed to transfer position H between drum 32 and charger 36 via guide 47 and feed roller 48. Thus, an image is transferred on paper sheet P. Sheet P on which an image has been transferred is guided by guide 57 and fed to fixing unit 51, and the image is fixed thereby. Thereafter, printed paper sheet P is delivered onto delivery tray 53 through 52*a* and 52*b*.

Since an image is transferred onto a lower surface of paper sheet P, even if sheets P are directly discharged, they can be stacked while their pages are ordered.

Door 24 provided on upper casing 22 faces drum 32 at transfer position H above drum 32. Bracket 55 is mounted on the inner surface of door 24 by mounting members 57. Above-mentioned transfer charger 36, paper guide 54, delivery roller 52*a*, and discharging brush 56 are mounted on bracket 55. Bracket 55 is pivotally supported at pivot shaft 25. Therefore, when paper sheet P jams midway along the convey path, door 24 of casing 22 is pivoted upward about pivot shaft 25 (FIGURE 1). Thus, transfer charger 36, paper guide 54, delivery roller 52*a*, and discharging brush 56 are pulled upward, and spaces 58 and 59 are defined above drum 32 and in a paper delivery section. Jamming sheet P can be found via spaces 58 and 59, and removed.

As described above, when jamming sheet P is removed, charger 36, guide 54, roller 52*a*, and brush 56 need only be lifted, a total weight of members to be lifted is greatly reduced, and hence, an operator's load can be reduced.

Since a total weight of members to be lifted is small, the structure of pivot shaft 25 of door 24 need not be reinforced, and the weight of the overall apparatus can be reduced.

Figure 5:
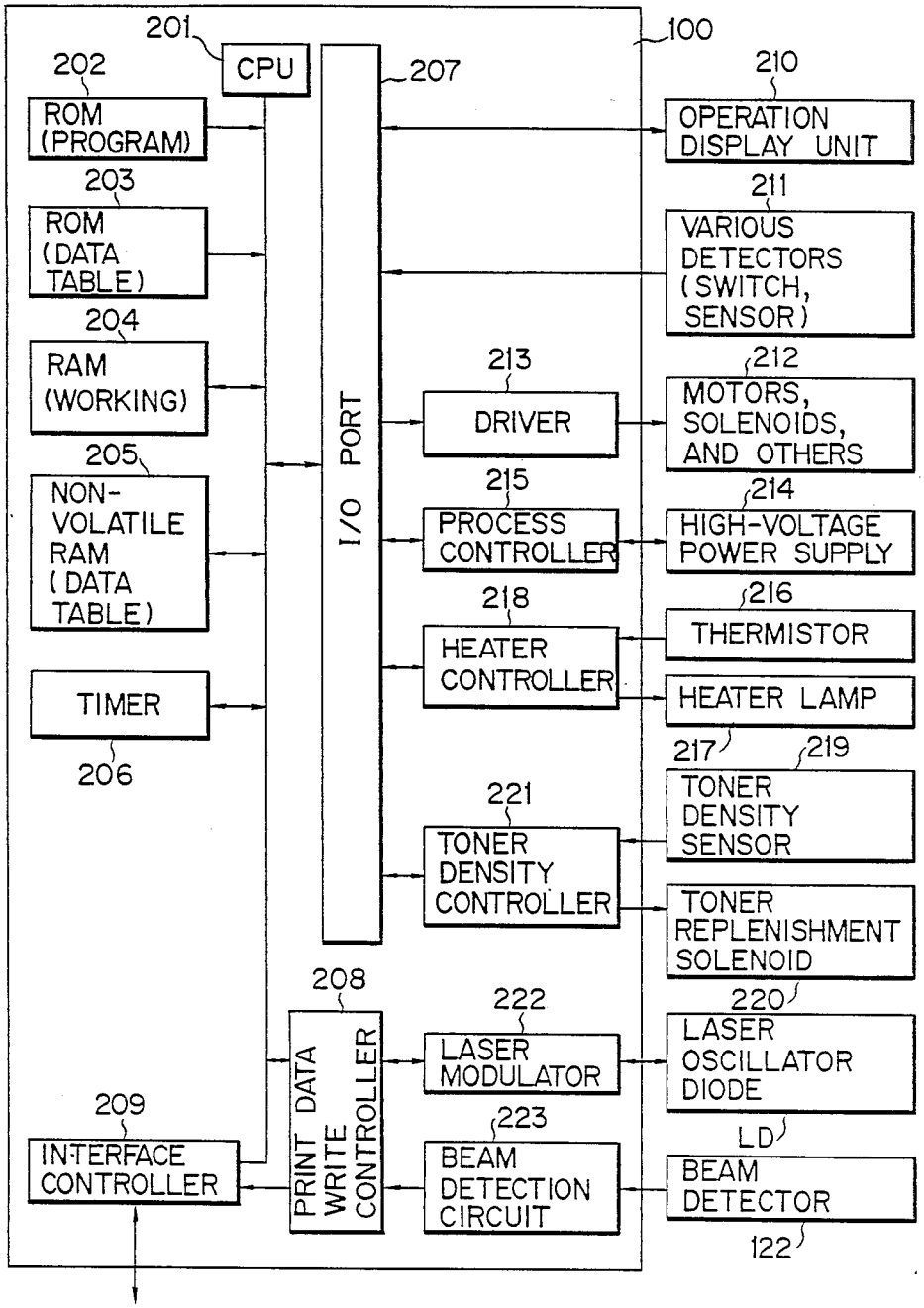
FIG. 5 is a control block diagram of the laser beam printer shown in FIG. 1.

FIG. 5 shows control unit 100 of laser beam printer arranged as described above. Control unit 100 basically comprises CPU (Central Processing Unit) 201, ROM (Read Only Memory) 202 storing system programs, ROM 203 storing a first data table, RAM (Random Access Memory) 204 serving as a working memory, programmable nonvolatile RAM 205 storing various data tables, timer 206, I/O port 207, print data write controller 208, and interface controller 209 for controlling an interface with a host system. Timer 206 is a versatile timer, and generates a fundamental timing signal for controlling paper convey and processes around photoreceptor in laser beam printer 21.

I/O port 207 outputs display data to operation display unit 210 provided on the upper surface of printer 21, and receives various switch data. I/O port 207 receives signals from various detectors (microswitches, sensors, and the like) 211, and outputs data to driver 213 for driving drive system (various motors, clutches, solenoids, and the like) 212. Port 207 performs data input/output operation to process controller 215 for controlling high-voltage power supply 214 which applies a high voltage to discharger 33 and charger 36, and performs control data input/output operation to heater controller 218 which controls a temperature of heater lamp 217 in fixing unit 51 upon reception of an output signal from temperature detection element 216 provided to fixing unit 51. Moreover, port 207 performs data input/output operation to toner density controller 221 for controlling toner replenishment solenoid 220 for replenishing toner powder to developer 25 upon reception of an output signal from toner density sensor 219 for measuring a toner density of toner powder in developer 35.

Print data write controller 208 controls laser modulator 222 for performing optical modulation of laser oscillator LD, so that print data of a video image transferred from a host system is written at a predetermined position on drum 32. In this case, beam detector 122 detects a laser beam scanned by polygonal mirror 39. The output signal from detector 122 is waveshaped by beam detection circuit 223 to generate a sync signal. The sync signal is then sent to print data write controller 208.

Interface controller 209 performs data input/output operation of status data to a host system, and receives command data and print data from the host system.

Control unit 100 with the above arrangement is disposed in a space below tray 53. Control unit 100 includes a plurality of LSIs arranged on a printed circuit board, and these LSIs include the elements represented as functional blocks in FIG. 5.

The operation of control unit 100 shown in FIG. 5 will be described briefly. CPU 201 exchanges data with interface controller 209, print data write controller 208, and I/O port 207 in accordance with the program stored in ROM 202. Upon execution of the program, data stored in ROM 203 and RAM 205 are looked up, and necessary control data is temporarily stored in RAM 204. Print data sent from the host system is received by control unit 100 at a predetermined timing under the control of interface controller 209. The received print data is sent to laser modulator 222 in units of predetermined blocks by controller 208. Laser modulator 222 modulates laser diode LD in accordance with print data. Modulated light from diode LD is scanned in the axial direction of drum 32 by polygonal mirror 39. In this case, the scanning operation is performed in synchronism with the rotation of drum 32. Since the scanning operation is repeatedly performed in one direction with respect to drum 32, an end of one scanning operation is detected by detector 122. A signal from detector 122 is sent to controller 208 through detection circuit 223. As a result, a print data block for the next scanning operation is output. CPU 201 performs necessary data exchange through I/O port 207 in order to control display unit 210, detectors 211, driver 213, process controller 215, heater controller 218, and toner density controller 221 as well as the above-mentioned print operation.

After a developed image formed on drum 32 is transferred to paper sheet P, drum 32 faces discharger 37, and the entire surface of drum 32 is exposed thereby. Then, the surface of drum 32 is uniformly charged by charger 33. Thereafter, the next printing process is started. Toner powder left on drum 32 without being transferred during the previous printing process is removed by developer 35. Developer 35 has both developing and cleaning functions, and utilizes an electrophotographic technique disclosed in, e.g., U.S. Pat. No. 4,664,504.

What is claimed is:

1. A printing apparatus comprising:

means for forming an image on an image carrier;

means for transferring the image formed on said image carrier by said image forming means to a sheet, so that an image is transferred onto a lower surface of the sheet;

means for conveying the sheet carrying the image on the lower surface thereof such that the lower surface faces down, said conveying means having first and second members facing each other and cooperating to clamp and convey the sheet;

means for stacking the sheet conveyed by said conveying means; and means for supporting at least one of said transfer means and said first member to be movable between a first position at which said transfer means faces said image carrier to achieve the image transfer from said image carrier to the sheet and said first member faces said second member so as to cooperate with each other, and a second position at which said transfer means and said first member do not face said image carrier and said second member, respectively.

2. A printing apparatus according to claim 1, wherein said transfer means is located above said image carrier.

3. A printing apparatus according to claim 1, wherein said supporting means is pivotable about an axis located above said image carrier, to permit access to an access opening defined between said image carrier and said transfer means.

4. A printing apparatus according to claim 1, further comprising means, located between said transfer means and said conveying means, for fixing the image transferred to the sheet by said transfer means, said fixing means having rotating members facing each other and conveying the sheet carrying the fixed image towards said first and second members.

5. A method for use in a printing apparatus, comprising the steps of:

forming an image on an image carrier;

transferring the image from the image carrier to a lower surface of a sheet by a transfer means;

conveying the sheet to a stacking means by a conveyor means, such that the image on the lower surface of the sheet is kept facing downward, the sheet being clamped by first and second members of the conveyor means while the sheet is being conveyed;

stacking the sheet conveyed to the stacking means by the stacking means; and supporting at least one of the transfer means and first member to be movable between a first position at which the transfer means faces the image carrier to achieve the image transfer from the image carrier to the sheet and at which the first and second members face each other to operate in cooperation, and a second position at which the transfer means and the first member are turned away from the image carrier and the second member, respectively.

* * * * *